US006005539A

United States Patent [19]

Nagakubo

[11] Patent Number: 6,005,539

[45] **Date of Patent: *Dec. 21, 1999**

[54] PLASMA DISPLAY APPARATUS

[75] Inventor: Tetsuro Nagakubo, Koufu, Japan

[73] Assignee: Pioneer Electronic Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/898,874

[22] Filed: Jul. 23, 1997

[30] Foreign Application Priority Data

Jul. 31, 1996 [JP] Japan ..... 8-217871

[51] Int. Cl.[6] ..... G09G 3/28

[52] U.S. Cl. ..... 345/60; 345/62

[58] Field of Search ..... 345/60, 62

[56] References Cited

U.S. PATENT DOCUMENTS

| | | | |
|---|---|---|---|
| 4,859,910 | 8/1989 | Iwakawa et al. | 345/60 |
| 5,629,716 | 5/1997 | Okamoto et al. | 345/60 |
| 5,661,500 | 8/1997 | Shinoda et al. | 345/60 |

*Primary Examiner*—Richard A. Hjerpe
*Assistant Examiner*—Ronald Laneau
*Attorney, Agent, or Firm*—Perman & Green, LLP

[57] ABSTRACT

A plasma display apparatus is disclosed wherein a column electrode driver for a PDP has a simpler constitution to facilitate wirings between the column electrode driver and column electrodes in the PDP. A plasma display apparatus comprises a plasma display panel having a plurality of row electrodes, and a plurality of column electrodes extending perpendicularly to the plurality of row electrodes, wherein the plurality of column electrodes are divided into first, second, and third row electrode groups corresponding to discharge cells of red, green, and blue; a first unit for driving the plurality of column electrodes on the basis of digital video data for red, green, and blue; a second unit for driving the row electrodes, wherein the first unit for driving said plurality of column electrodes comprises a first shift register for receiving the digital video data for red, a second shift register for receiving the digital video data for green, a third shift register for receiving the digital video data for blue, and a latch circuit for latching outputs of the first, second, and third shift registers to position the latched outputs in the manner that the latched outputs are associated with the corresponding first, second, and third row electrode groups.

1 Claim, 5 Drawing Sheets

PLASMA DISPLAY APPARATUS

BACKGROUND OF THE INVENTION

1. Field of the Invention

This invention relates to a plasma display apparatus.

2. Description of the Related Art

For example, a plasma display panel (designated as PDP hereinafter) is known as a plane display apparatus of a dotted matrix type. In many cases, the PDP is used as a display of a personal computer, a word processor, or the like. Since the PDP can perform a high speed display and can easily provide a large screen, PDP is expected as larger sized flat type display means having the size of 20 inches or more.

FIG. 1 shows a surface discharge type PDP comprising a 3-electrode structure of an AC driving type in a unit cell. This PDP comprises: a pair of parallel disposed glass substrates 301 and 302 spaced through a discharge space 308; a plurality of paired, parallel sustaining electrodes (maintaining electrodes) X and Y formed on an inner surface of the glass substrate 301 forming a display surface; a dielectric layer 306 covering the sustain electrodes X and Y; and a protecting layer 307 made of MgO and covering the dielectric layer 306. Each of the sustain electrodes X and Y is made up of a belt-shaped wider transparent electrode 303 and a bus electrode 304 of a metal film overlapped for compensating a conductivity of the sustain electrode.

The PDP further comprises: barrier ribs 310 formed on an inner surface of the glass substrate 302 and extending perpendicularly to the sustain electrodes X and Y, the barrier ribs dividing the discharge space 308 to unit light emitting regions; a column electrode 305 formed between the barrier ribs 310 on the glass substrate and extending perpendicularly to the sustain electrodes X and Y; and a plurality of fluorescent layers 309 for emitting predetermined colored light. The discharge space 308 is filled with a discharge gas including neon and a smaller quantity of xenon.

In the operation of the above PDP, a driving voltage exceeding a discharge starting voltage is applied between the sustain electrodes X and Y. As a result, a surface discharge is caused near a surface of the dielectric layer 306, predetermined amount of wall charges are then accumulated in the surface of the dielectric layer 306, and the discharge is ceased.

A surface discharge is caused each tine a sustaining pulse having an opposite polarity to that of the wall charges is alternately applied to the sustain electrodes X and Y. Ultraviolet rays generated by the application of the pulses excite the fluorescent layer 309 to emits a light therefrom.

FIG. 2 shows a block diagram illustrating a driving apparatus of a conventional plasma display panel. In FIG. 2, a video signal processor 101 receives a composite video signal to extract R, G, and B video signals corresponding to red, green, and blue video components therefrom to supply the extracted video signals to A/D convertors 104R, 104G, and 104B. A synchronous separator 102 extracts horizontal and vertical synchronous signals from the composite video signal, thereby supplying them to a row electrode driver 108. Signal processors 105R, 105G, and 105B process signal outputs from the corresponding A/D convertors 104R, 104G, and 104B in the manner that the signal outputs can be stored in the corresponding frame memories 106R, 106G, and 106B. Then, the processed signal outputs are stored in the corresponding frame memories 106R, 106G, and 106B. The signals stored in the frame memories 106R, 106G, and 106B are sequentially read out and mixed in a mixture processor 107. The mixed signals from the mixture processor 107 are supplied to a column electrode driver 409 in the order of red, green, and blue, thereby driving the corresponding column electrodes $D_1$–$D_{3n}$.

The synchronous separator 102 supplies its output signal to a row electrode driver 108 at a proper timing through a controller 103 to drive row electrodes $X_1$–$X_m$, and $Y_1$–$Y_m$.

When the row electrode driver 108 applies a scanning pulse to a PDP 110, the PDP 110 starts discharge light emissions in accordance with pixel data pulses, and then maintains the light emitting state during a period in which the application of sustain pulses to the PDP 110 is continued. when the row electrode driver 108 applies erasing pulses to the PDP 110, the discharge light emissions are ceased. Thus, the driving pulses for the row electrode consist of the scanning pulses, the sustain pulses, and the erasing pulse.

FIG. 3 shows a detailed diagram of the column electrode driver. In FIG. 3, 64-bit shift registers $\mathbf{501}_1$–$\mathbf{501}_{3n}$ receive the data consisting of red, green, and blue and subjected to the mixing processes, and then convert the received data in series into parallel ones. Latches $\mathbf{502}_1$–$\mathbf{502}_n$ latch the outputs of the 64-bit shift registers $\mathbf{501}_1$–$\mathbf{501}_{3n}$. Outputs of the latches control column electrodes $D_1$–$D_m$.

In the conventional colored PDP, in order to drive each cell of red, green, and blue in one pixel, a problem arises that the mixing processes of three primary color data are necessary before the column electrode driver receives them. In addition, since a shift register generally includes a plurality of bits consisting of binary codes, and one data corresponding to three bits of red, green, and blue is distributed over an adjacent shift register, a further problem arises that its processing is required.

OBJECT OF THE INVENTION

In consideration of the above problems, a main object of the invention is to provide a plasma display apparatus in which a column electrode driver has a uncomplicated constitution to facilitate wirings between the column electrode driver and column electrodes for a plasma display panel.

SUMMARY OF THE INVENTION

The present invention provides a plasma display apparatus comprising: a plasma display panel having a plurality of row electrodes, and a plurality of column electrodes extending perpendicularly to said plurality of row electrodes, wherein said plurality of column electrodes are divided into first, second, and third row electrode groups corresponding to discharge cells of red, green, and blue; means for driving said plurality of column electrodes on the basis of digital video data for red, green, and blue; means for driving said row electrodes, wherein said means for driving said plurality of column electrodes comprises a first shift register for receiving the digital video data for red, a second shift register for receiving the digital video data for green, a third shift register for receiving the digital video data for blue, and means for latching outputs of said first, second, and third shift registers to position the latched outputs in the manner that the latched outputs are associated with the corresponding first, second, and third row electrode groups.

A plasma display apparatus according to the invention includes three shift registers in a column electrode driver to be associated with three primary colors of red, green, and blue, respectively. Furthermore, the three resistors are provided for each of red, green, and blue data. The shift registers are sequentially driven in the order of red, green and blue in an area for driving FETs (Field Effect Transistors) at the final stage of the plasma display apparatus, so that the driving process can be performed with a simple construction without mixing the data of red, green and blue before the shift registers receive the data.

In the plasma display apparatus of the invention, as mentioned above, the shift registers in the column electrode drivers are associated with three primary colors of red, green and blue, and provided for each data of red, green and blue. The shift registers are further sequentially driven in the order of red, green and blue in a section for driving the FET at the final stage of the plasma display apparatus, so that the driving process can be executed with a simple construction without mixing the data of red, green and blue before the shift registers receive the data.

BRIEF DESCRIPTION OF THE DRAWINGS

The aforementioned aspects and other features of the invention are explained in the following description, taken in connection with the accompanying drawing figures wherein.

DETAILED DESCRIPTION OF THE PREFERRED EMBODIMENT

A preferred embodiment of a plasma display apparatus according to the invention will be described hereinbelow with reference to FIGS. 4–5.

Figure 4:
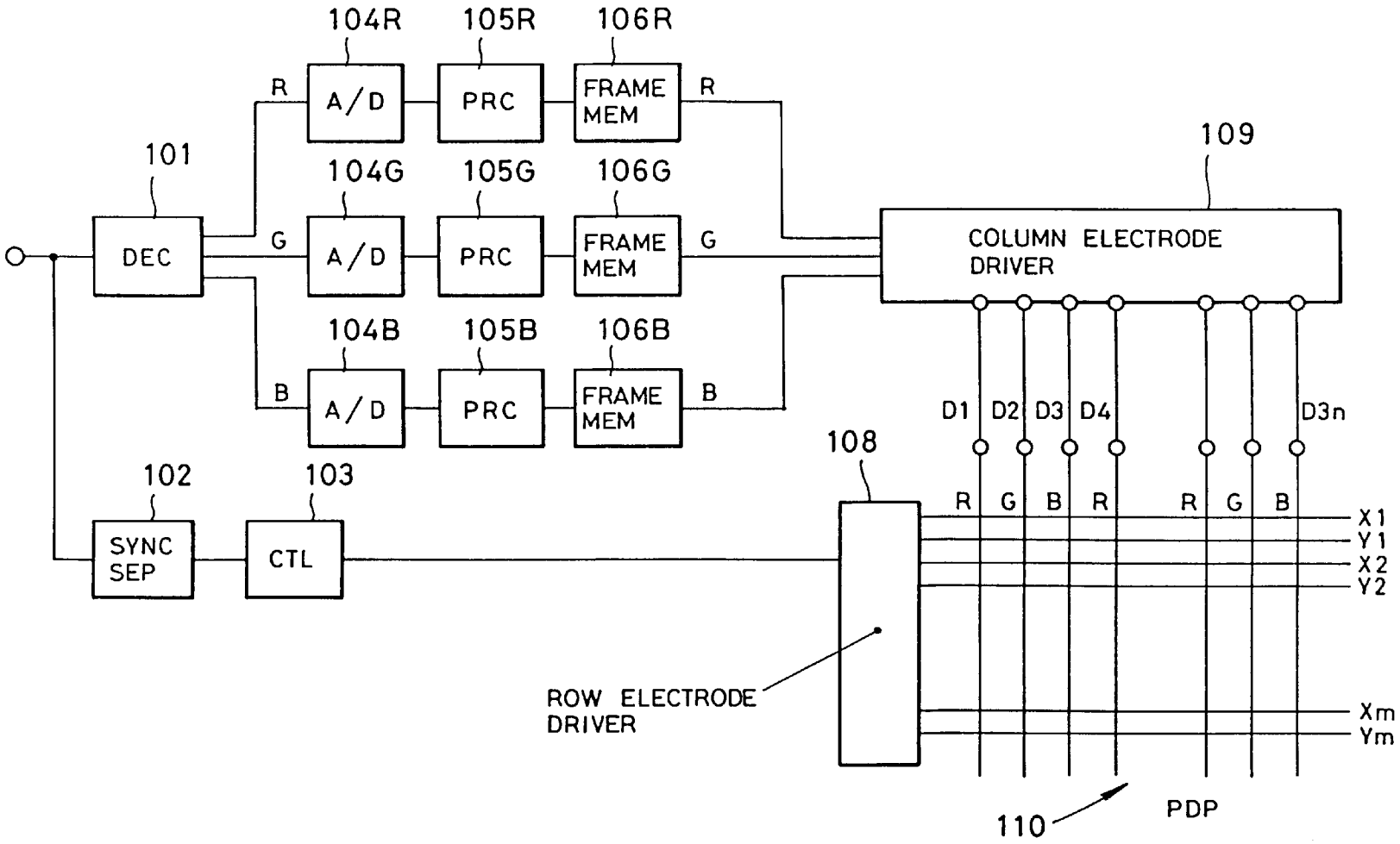
FIG. 4 is a block diagram showing one embodiment of a plasma display apparatus according to the present invention.

FIG. 4 is a block diagram illustrating a driving apparatus for a plasma display panel according to the invention. In FIG. 4, a video signal processor 101 receives composite video signal to divide the received signal into red, green, and blue video signals corresponding to red, green, and blue video components, and supplies the divided video signals to the corresponding A/D convertor 104R, 104G, and 104B. A synchronous separator 102 extracts horizontal and vertical synchronous signals from the composite video signal, and then supplies the extracted signal to a row electrode driver 108. Signal processor 105R, 105G, and 105B receive signal outputs from the A/D convertors 104R, 104G, and 104B to process the received signal outputs for storing them in frame memories 106R, 106G, and 106B. The frame memories 106R, 106G, and 106B sequentially supply the signals stored therein to shift registers corresponding to red, green, and blue in a column electrode driver 109, thereby driving column electrodes $D_1$–$D_{3n}$.

On the other hand, the synchronous separator 102 supplies an output signal to the row electrode driver 108 at a proper timing through a controller 103, thereby driving the row electrodes $X_1$–$X_m$ and $Y_1$–$Y_m$.

When the row electrode driver 108 applies a scanning pulse to a PDP 110, the PDP starts the discharge light emissions dependently on the contents of pixel data pulses, and then maintains the light emitting state during a period in which the application of sustain pulses to the PDP is continued. After that, the application of an erasing pulse from the row electrode driver 108 to the PDP ceases the discharge light emission. Thus, the driving pulses for the row electrode include the scanning pulses, the sustain pulses, the erasing pulses.

Figure 5:
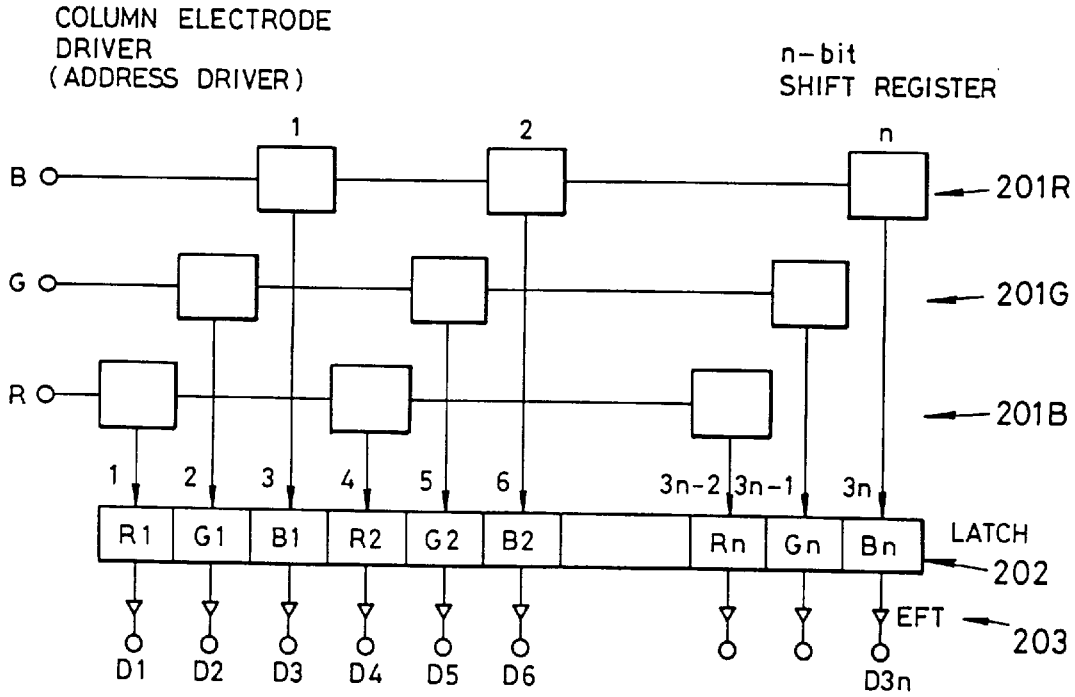
FIG. 5 is a block diagram showing one embodiment of a column electrode driver in the plasma display apparatus according to the present invention.

FIG. 5 is a diagram showing the details of the column electrode driver of FIG. 4. In FIG. 5, (3xn)-bit shift registers 201R, 201G, and 201B receive data of red, green, and blue, and then convert the received data in series to parallel one. A latch circuit 202 including (3xn) bits latches the converted data. The latched data drives the column electrodes $D_1$–$D_{3n}$.

Shift registers 201R, 201G, and 201B have their outputs connected to a latch circuit 202 in the order of red, green, and blue bits, so that a mixing process for mixing three bits is unnecessary, and the circuit construction is simplified.

Figure 1:
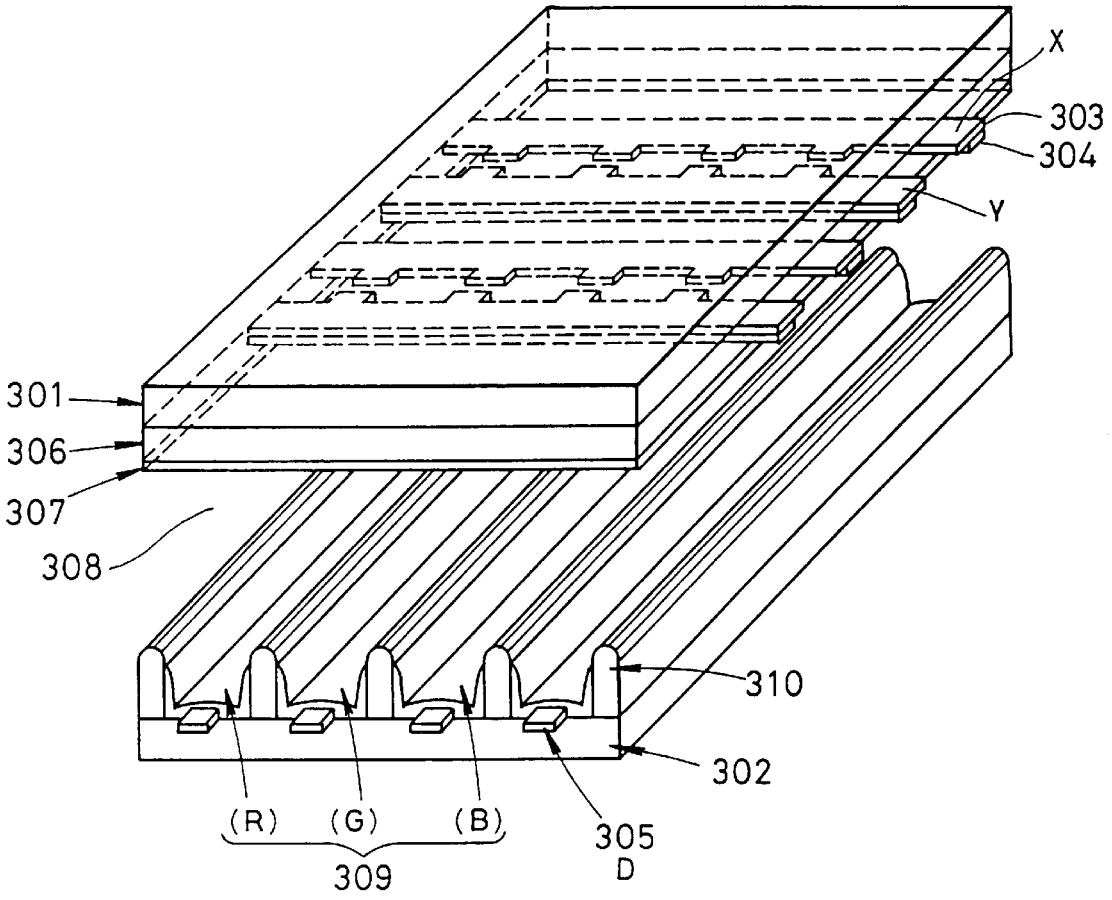
FIG. 1 is a enlarged perspective view showing a plasma display panel.
Figure 2:
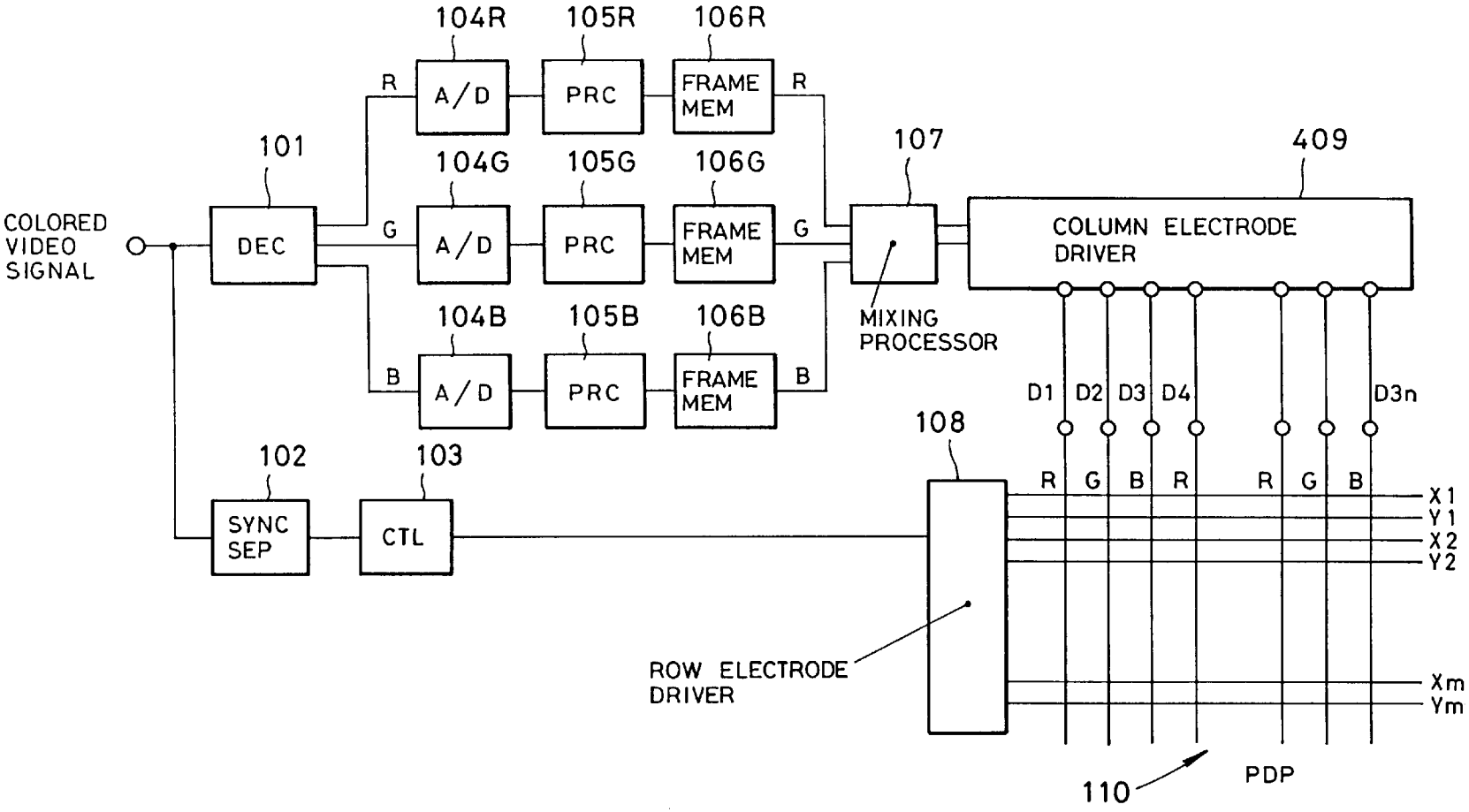
FIG. 2 is a block diagram showing a conventional plasma display apparatus.
Figure 3:
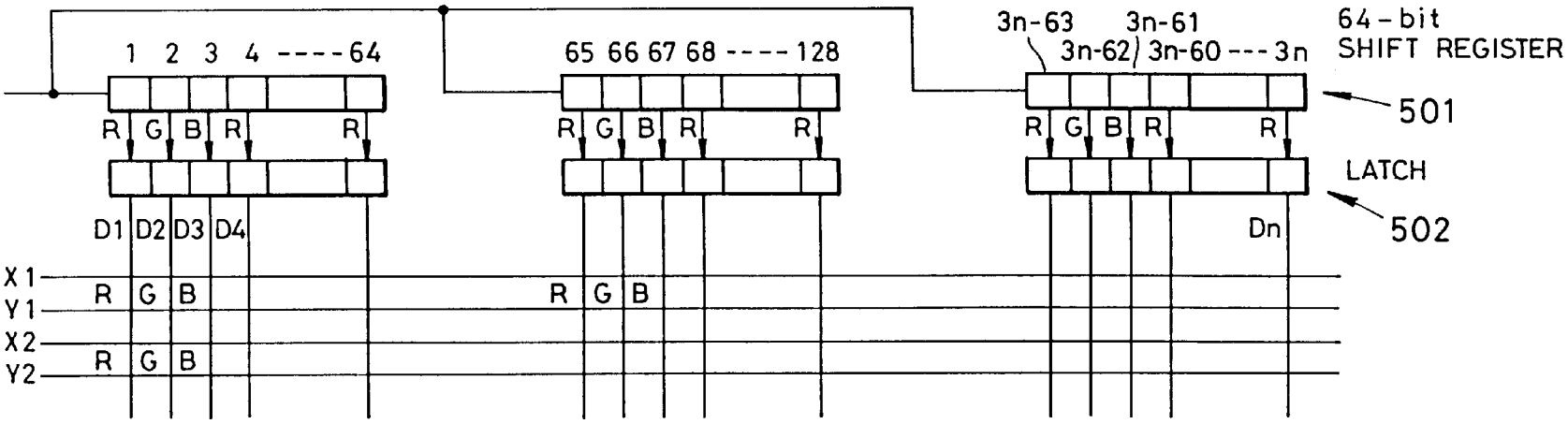
FIG. 3 is a block diagram showing a column electrode driver in a conventional plasma display apparatus.

The PDP has a similar structure to that of the conventional PDP shown in FIG. 1. The plurality of column electrodes 305, which are formed perpendicularly to the sustain electrodes X and Y serving as row electrodes, are classified into first, second, and third row electrode groups corresponding to the discharge cells of red, green, and blue. The electrode groups are controlled through the latch circuit 202 and FETs 203 connected in series to the shift registers 201R, 201G, and 201B in FIG. 2.

What is claimed is:

1. A plasma display apparatus comprising:

a plasma display panel having a plurality of parallel row electrodes, and 3n (n is a natural number) number of column electrodes extending perpendicularly to said plurality of row electrodes, wherein said 3n column electrodes constitute an array of electrode sets, each of which consists of three electrodes for displaying three primary colors, respectively, said three electrodes in each of the sets being arranged in a predetermined order, said plasma display apparatus further comprising:

means for dividing a video data supplied to the plasma display apparatus into three different color pixel data; and means for driving said 3n column electrodes in accordance with the three color pixel data;

wherein said means for driving said 3n column electrodes comprises a first shift register for receiving and storing only first-color pixel data constituting a horizontal line, a second shift register for receiving and storing only second-color pixel data constituting the horizontal line, a third shift register for receiving and storing only third-color pixel data constituting the horizontal line, and means for latching outputs of said first, second, and third shift registers, wherein the k-th ($1 \leqq k \leqq n$; where k is a natural number) first-color pixel data is applied to the (3k−2)-th column electrode, the k-th second-color pixel data is applied to the(3k−1)-th column electrode, and the k-th third-color pixel data is applied to the 3k-th column electrode.

* * * * *